United States Patent [19]

Jinnouchi

[11] Patent Number: 4,532,845

[45] Date of Patent: Aug. 6, 1985

[54] TURRET PUNCH PRESSES

[75] Inventor: Katsumi Jinnouchi, Hatano, Japan

[73] Assignee: Amada Company, Limited, Japan

[21] Appl. No.: 435,317

[22] Filed: Oct. 19, 1982

[30] Foreign Application Priority Data

Oct. 20, 1981 [JP] Japan ..... 56-166451
Sep. 11, 1982 [JP] Japan ..... 57-137939[U]

[51] Int. Cl.[3] ..... B26D 5/02
[52] U.S. Cl. ..... 83/552; 83/571; 83/640; 83/685; 83/699; 83/559
[58] Field of Search ..... 83/549–552, 83/641, 640, 559, 571, 685, 699

[56] References Cited

U.S. PATENT DOCUMENTS

| | | | |
|---|---|---|---|
| 3,370,492 | 2/1968 | Treff | 83/71 |
| 3,518,908 | 7/1970 | Daniels | 83/551 |
| 3,902,389 | 9/1975 | Brown et al. | 83/552 |
| 4,285,259 | 8/1981 | Jelinek et al. | 83/552 |
| 4,412,469 | 11/1983 | Hirata et al. | 83/552 |

*Primary Examiner*—James M. Meister
*Assistant Examiner*—John L. Knoble
*Attorney, Agent, or Firm*—Wigman & Cohen

[57] ABSTRACT

A turret punch press is provided with a rotatable upper turret holding a number of upper tools and a rotatable lower turret holding a number of lower tools. One pair or more of the upper and lower tools are so arranged as to be rotatable in the upper and lower turrets, respectively, and are connected and disconnected with a drive.

10 Claims, 9 Drawing Figures

TURRET PUNCH PRESSES

BACKGROUND OF THE INVENTION

1. Field of the Invention

The present invention relates generally to turret punch presses having a pair of upper and lower turrets on which a plurality of pairs of upper and lower punching tools can be mounted to punch a variety of holes in sheet materials such as sheet metals. More particularly, the present invention rlates to apparatus for synchronously indexing or rotating the upper and lower punching tools in the upper and lower punching turrets in the turret punch presses to make the best use of the punching tools.

2. Description of the Prior Art

As is well known, the turret punch press comprises a vertically movable ram and a pair of rotatable upper and lower turrets for holding a plurality of upper and lower tools which are varied in size and shape to punch a variety of holes in sheet materials such as sheet metals. The upper and lower turrets are vertically spaced from each other substantially beneath the ram and horizontally disposed on their respective shafts which are vertically disposed so as to coaxially align with each other. Each of the upper punching tools on the upper turret is so located as to vertically align with either of the lower tools on the lower turret in order to cooperate with each other to punch holes of a peculiar shape. Also, the upper and lower turrets are so arranged as to be simultaneously rotated by power to bring a desired pair of the upper and lower tools into a position just beneath the ram so as to enable them to be worked by the ram to punch holes of a desired shape. In this arrangement, a workpiece such as a sheet metal to be punched is horizontally fed by a plurality (usually a pair) of clamping means into a position between the upper and lower turrets namely the upper and lower tools which have been placed just beneath the ram by the upper and lower turrets. The clamping means are so arranged as to grip an end of the workpiece and be moved by power along both the X and Y axes namely in all directions toward and away from the upper and lower turrets to bring any portion of the workpiece into a position beneath the ram. Also, in order to automatically and continuously punch a number of holes varied in size and shape in the workpiece, the upper and lower turrets and the clamping means are so arranged as to be rotated and moved under a numerical control which is preprogrammed.

In punching operations in the turret punch presses of the above described arrangement, it is very often desired to punch a plurality of holes which are all the same in shape and size but are different in direction in worksheets. For example, there are cases where it is desired to punch in a workpiece many holes of T-shape and inverted T-shape which are quite identical in shape and size and are different only in direction. As another example, it is often necessary to punch in a workpiece many I-shaped holes identical in shape and size at different angles to an edge of the workpiece. Of course, there are cases where it is desired to punch holes identical in shape and size in a direction in some workpieces and in different directions in other workpieces.

In the conventional turret punch presses, however, it has been impossible to satisfactorily punch holes identical in shape and size in different directions in workpieces in an economical manner. For instance, in order to punch holes in diffeent directions in workpieces, a desired pair of the upper and lower tools of a desired shape and size are manually adjusted in direction in the upper and lower turrets in a conventional turret punch press. As a matter of course, however, it is very difficult and time-consuming to accurately align the upper and lower tools in a desired direction in the upper and lower turrets in this manner. Therefore, for the purpose of easy alignment, each of the upper and lower tools is provided with an alignment key and each of the upper and lower turrets is formed with a plurality of grooves with which the alignment key is to be selectively engaged in some of conventional turret punch presses. In this manner, however, of course it is impossible to smoothly adjust the upper and lower tools in any direction in the upper and lower turrets to punch holes common in shape and size in all directions in workpieces. Also, it is still time-consuming and troublesome to manually change the upper and lower tools in any direction in the upper and lower turrets, and furthermore the arrangement is costly since it is necessary to form a plurality of grooves in the upper and lower turrets. Anyway, as a greatest disadvantage, it is impossible to continuously punch holes which are identical in shape and size and different in direction without discontinuing the punching operation in the arrangements in which the upper and lower tools are to be manually changed in direction in the upper and lower turrets. In order to punch holes different in direction in workpieces in this manner, it is necessary to discontinue the punching operation to change the upper and lower tools in direction after having punched holes common in direction.

For the above described reasons, it has been often the case that many pairs of upper and lower tools which are all the same in shape and size are mounted together on the upper and lower turrets to continuously punch a variety of holes including those which are common in shape and size and different only in direction. In this case, however, of course the high cost is inevitably necessary for the upper and lower tools and also the trouble is that only a limited number of pairs of the upper and lower tools can be mounted on the upper and lower turrets.

SUMMARY OF THE INVENTION

It is a general object of the present invention to provide a turret punch press in which holes which are identical in shape and size and different in direction can be accurately and economically punched in workpieces.

It is a specific object of the present invention to provide a turret punch press in which a pair of upper and lower tools can be effectively used to easily punch in workpieces holes which are identical in shape and size and are different in direction.

It is therefore an object of the present invention to provide a turret punch press in which the upper and lower tools can be automatically synchronously rotated or indexed in the upper and lower turrets.

It is thus a further object of the present invention to provide a turret punch press in which the upper and lower tools can be automatically synchronously rotated or indexed in the upper and lower turrets under a numerical control to continuously punch a variety of holes including those which are identical in shape and size and different in direction.

It is another object of the present invention to provide a turret punch press in which the rotary upper and lower tools will be automatically returned to their original rotational positions for the convenience of succeeding operations as soon as they are put out of operation.

It is another object of the present invention to provide a turret punch press in which the upper and lower tools can be automatically synchronously rotated in the upper and lower turrets but can be automatically fixed thereon by means of a fixing means while not being rotated or indexed.

According to the present invention, basically these objects are accomplished by mounting the upper and lower tools rotatably on the upper and lower turrets and providing driving means for synchronously rotating the upper and lower tools.

The rotary upper and lower tools are so arranged as to be mechanically connected and disconnected with the driving means, and also there is provided a fixing means which is arranged to keep the rotary upper and lower tools stopped from rotating.

Other and further objects and advantages of the present invention will be apparent from the following description and accompanying drawings which, by way of illustration, show a preferred embodiment of the present invention and the principle thereof.

DESCRIPTION OF THE PREFERRED EMBODIMENTS

Figure 1:
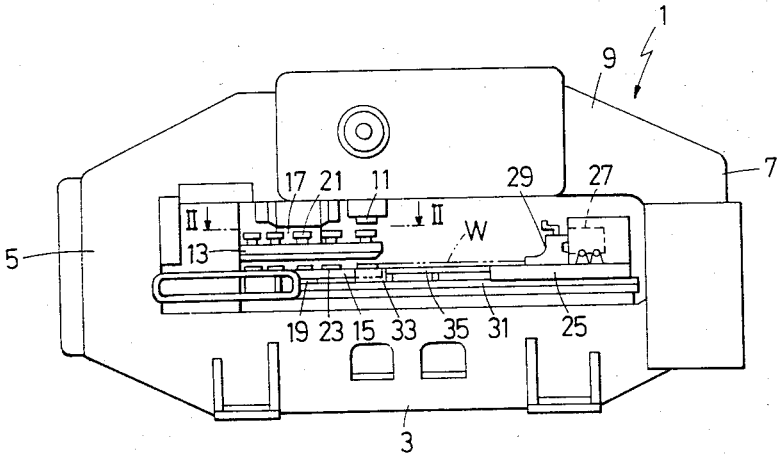
FIG. 1 is a front elevational view of a turret punch press embodying the principles of the present invention.

Referring to FIG. 1, there is shown a turret punch press which is generally designated by the numeral 1 and is constructed of a base 3, a pair of side frames 5 and 7 vertically fixed to the ends of the base 3 and an overhead frame 9 which is supported by the side frames 5 and 7. In this connection, however, the turret punch press 1 can be so constructed as to be of a C-shaped frame in which the side frame 7 is omitted and the overhead frame 9 is a little shorter, although it is shown as being of a bridge-shaped frame in the preferred embodiment.

The turret punch press 1 comprises a ram 11 and an upper turret 13 and a lower turret 15 having shafts 17 and 19, respectively, and holding a plurality of upper tools 21 and lower tools 23 which are varied in size and shape. The ram 11 is vertically movably mounted at the substantially midway portion of the overhead frame 9 in such a manner as to be vertically driven by power to act on the upper and lower punching tools 21 and 23 placed therebeneath. The upper turret 13 is so mounted as to rotatably hang from the overhead frame 9 with its shaft vertical to rotate partially beneath the ram 11, while the lower turret 15 is rotatably mounted on the base 3 just beneath the upper turret 13 in a coaxial relation therewith. Also, the upper and lower turrets 13 and 15 are so arranged that pairs of the upper and lower tools 21 and 23 common in size and shape vertically align with each other, and in this arrangement they are simultaneously driven by power to bring a desired pair of the upper and lower tools 21 and 23 into a position beneath the ram 11. As seen from FIG. 2, the pairs of the upper and lower tools 21 and 23 are typically so mounted on the upper and lower turrets 13 and 15 as to stand in a circle along the peripheries thereof at an equal radial distance from the axes of the shafts 17 and 19 of the upper and lower turrets 13 and 15.

In order to feed and position the workpiece W to be punched, the turret punch press 1 is provided with a first carriage 25 which is movable toward and away from the upper and lower turrets 13 and 15 and a second carriage 27 which is slidably mounted on the first carriage 25 and holds a clamping apparatus 29 for clamping the workpiece W. The first carriage 25 is slidably mounted on rails 31 and is fixed on the upper portion of the base 3 so that it may be horizontally moved toward and away from the upper and lower turrets 13 and 15 when driven by power. The second carriage 27 holding the clamping apparatus 29 is mounted on the first carriage 25 so that it may be horizontally moved by power in directions at right angles with the rails 31. Also, a fixed table 33 is provided on the base 3 so that the workpiece W can slide thereon, and furthermore a pair of movable tables 35 may be fixed to the first carriage 25 to hold the extending ends of workpiece W.

In the above described arrangement, the workpiece W which is gripped by the clamping apparatus 29 can be fed into a position between the upper and lower turrets 13 and 15 and positioned just beneath the ram 11 by moving the first and second carriages 25 and 27. Before or as soon as the workpiece W is positioned between the upper and lower turrets 13 and 15 just beneath the ram 11, a desired pair of upper and lower punching tools 21 and 23 are placed just beneath the ram 11 by the upper and lower turrets 13 and 15, and thus the workpiece W is punched by the upper and lower punching tools 21 and 23 when the ram 11 is lowered to press the upper punching tool 21. Also, a number of holes varied in size and shape are automatically and continuously punched in the workpiece W by moving the upper and lower turrets 13 and 15 and the first and second carriages 25 and 27 under a numerical control which is preprogrammed.

Figure 2:
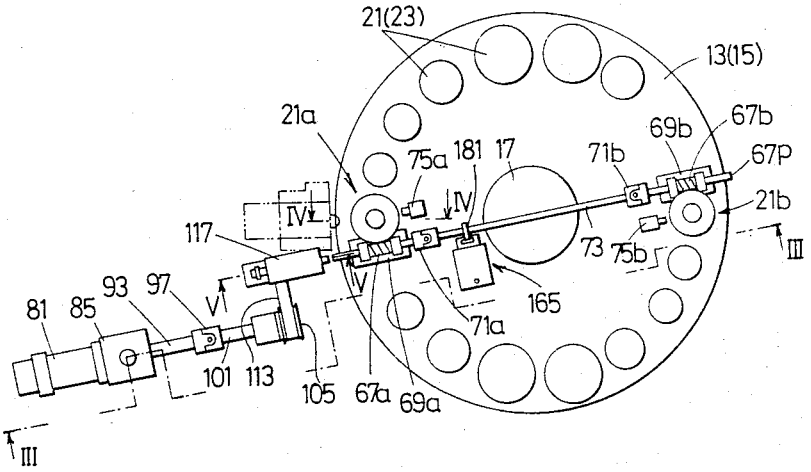
FIG. 2 is a plan view schematically showing a portion of the turret punch press shown in FIG. 1 in section taken along the lines II—II of FIGS. 1 and 3.
Figure 3:
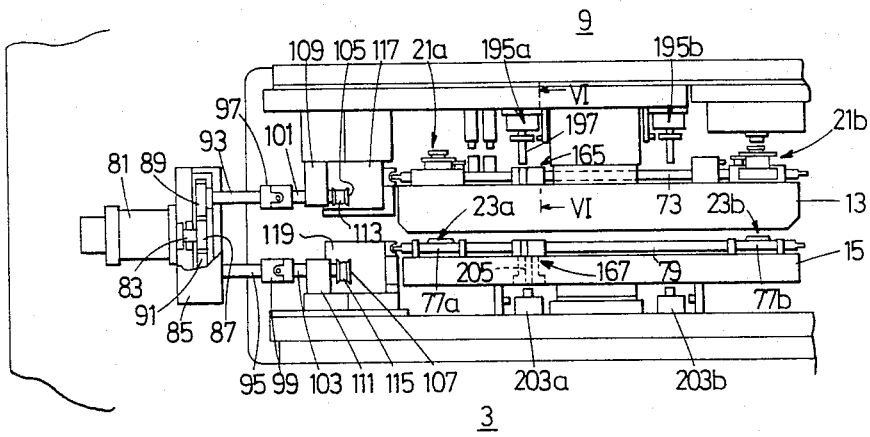
FIG. 3 is an enlarged sectional view of a portion of the turret punch press shown in FIG. 1 substantially taken along the lines III—III of FIG. 2.

Referring to FIGS. 2 and 3, two upper tools 21*a* and 21*b* are so disposed as to be rotatable in the upper turret 13, and also two lower tools 23*a* and 23*b* vertically aligning with the upper tools 21*a* and 21*b*, respectively, are likewise rotatably held in the lower turret 15. The upper tools 21*a* and 21*b* and the lower tools 23*a* and 23*b* will be hereinafter referred to as "upper rotary tools" and "lower rotary tools", respectively, for the purpose of discrimination from the other upper and lower punching tools 21 and 23. The upper rotary tools 21*a* and 21*b* are located radially opposite to each other on the upper turret 13, and the lower rotary tools 23*a* and 23*b* are located also opposite to each other on the lower turret 15. Thus, of course the upper rotary tools 21*a* and 21*b* will cooperate with the lower rotary tools 23*a* and 23*b*, respectively, to punch the workpiece W when placed just under the ram 11 by the upper and lower turrets 13 and 15.

Figure 4:
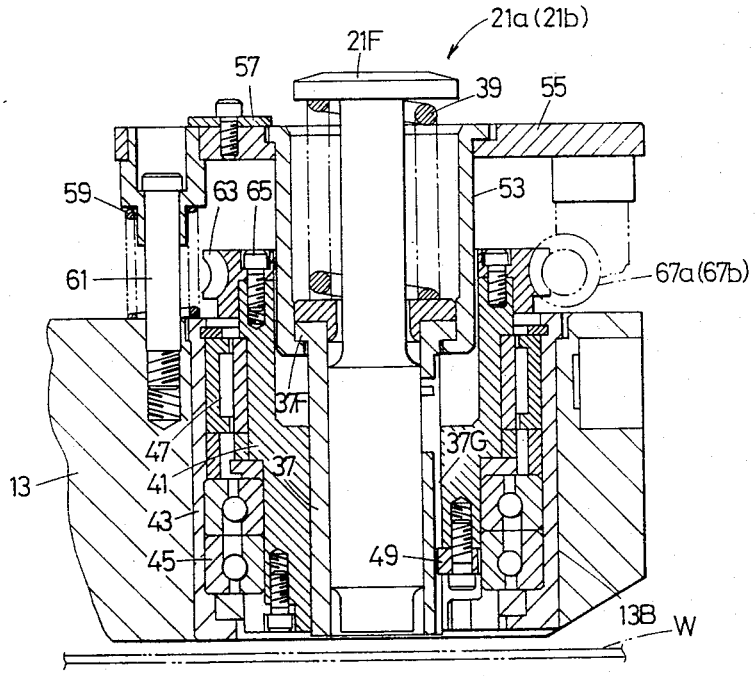
FIG. 4 is an enlarged sectional view taken along the line IV—IV of FIG. 2.

Referring to FIG. 4, the upper rotary tool 21*a* and 21*b* will be exemplarily described together by the use of the expression "upper rotary tool 21*a* (21*b*)", since they are all the same in construction and function and are mounted on the upper turret in all the same manner. The upper rotary tool 21*a* (21*b*) is conventional in that it is provided at its top end with a flange 21F and is vertically slidably held in a cylindrical guide member 37 which is formed at its top end with a flange 37F. As is also conventional, the upper rotary tool 21*a* (21*b*) is provided with a stripping spring 39 between the flange 21F and the guide member 37, and it is held by the stripping spring 39 so that its lower end will be usually kept retracted into the guide member 37. Although the upper rotary tool 21*a* (21*b*) is slidably held in the guide member 37, it is prevented from rotating therein by a suitable means. The guide member 37 holding the upper rotary tool 21*a* (21*b*) is slidaby held in a cylindrical rotary member 41 which is rotatably held in a cylindrical holding member 43 by means of a plurality of ball bearings 45 and middle bearings 47. Although the guide member 37 is vertically slidably held in the cylindrical rotary member 41, it is prevented from rotating therein by a key member 49 which is fixed to the cylindrical rotary member 41 in engagement with a groove 37G formed on the guide member 37. The cylindrical holding member 43 holding the cylindrical rotary member 41 is vertically and fixedly held in a bore 13B which is vertically formed through the upper turret 13 in a manner such that the upper rotary tool 21*a* (21*b*) can be downwardly projected to make punching actions. Also, the guide member 37 is carried by a cylindrical carrier member 53 which engages the flange 37F of the guide member 37 and is secured to an annular holding member 55 by a fixing member 57. The annular holding member 55 is resiliently held by a plurality of lift springs 59 in a manner such that it can be vertically moved along a plurality of guide rods 61 vertically fixed to the top surface of the upper turret 13 when the lift springs 59 are compressed and released. In this connection the lift springs 59 are strong enough to raise the upper tool 21*a* (21*b*) and other members, but they are designed to be weaker than the stripping spring 39.

In the above described arrangement, the upper rotary tool 21*a* (21*b*), when depressed by the ram 11, will be lowered firstly to compress the lift springs 59 to lower the guide member 37 through the flange 37F and the stripping spring 39 which is stronger than the lift springs 59. Then, when the lower end of the guide member 37 is lowered into contact with the workpiece W to be punched, the upper rotary tool 21*a* (21*b*) will be further lowered to compress the stripping spring 39 to punch the workpiece W. Also, when released from the ram 11 after having punched the workpiece W, the upper rotary tool 21*a* (21*b*) will be firstly stripped out of the workpiece W by the stripping spring 39 and then raised up by the lift springs 59.

Referring again to FIG. 4, in order to rotate the cylindrical rotary member 41 in the cylindrical holding member 43, a worm wheel 63 is fixed to the top of the cylindrical rotary member 41 by a plurality of bolts 65. The worm wheel 63 is engaged with a worm 67*a* (67*b*) which is horizontally and rotatably provided on the upper turret 13.

From the above description, it will be readily understood that the cylindrical rotary member 41 will be rotated by the worm wheel 63 to rotate the upper rotary tool 21*a* (21*b*) when the worm 67*a* (67*b*) is rotated. Thus, it will be also understood that the upper rotary tool 21*a* (21*b*) can be indexed or changed in direction by rotating the worm 67*a* (67*b*) to punch in the workpiece W a variety of holes which are identical in shape and size but are different in direction.

Figure 5:
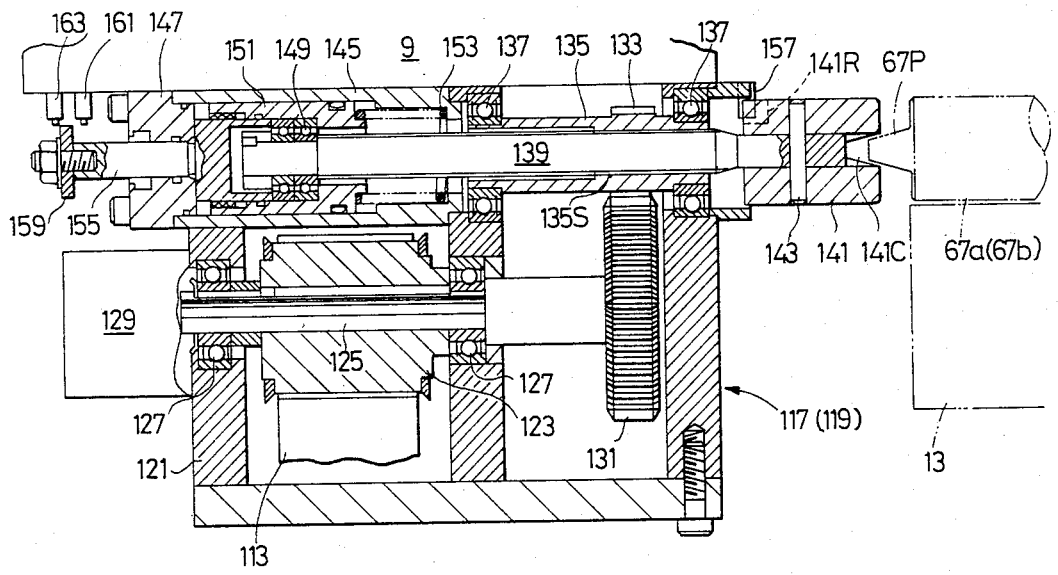
FIG. 5 is an enlarged sectional view of a portion of FIG. 2 shown in section taken along the line V—V of FIG. 2.

Referring to FIGS. 2 and 3, the worms 67*a* and 67*b* for the upper rotary tools 21*a* and 21*b*, respectively, are horizontally and rotatably supported by supporting members 69*a* and 69*b*, respectively, in such a manner as to align radially with each other in a line. Each of the outer ends of the worms 67*a* and 67*b* is so designed as to be projected radially outwardly from the upper turret 13. There is formed a pointed end 67P as best shown in FIG. 5 for a purpose which will be described in great detail hereinafter. The worms 67*a* and 67*b* are connected with each other at their inner ends by means of joint means 71*a* and 71*b* (shown only in FIG. 2) by a connecting rod 73 which is so provided as to horizontally and rotatably extend through the shaft 17 of the upper turret 13. Also, detecting means 75*a* and 75*b* are provided near the upper rotary tools 21*a* and 21*b*, respectively, on the upper turret 13 so as to detect that the upper rotary tools 21*a* and 21*b* are at their original rotational positions in a manner to be described in great detail hereinafter.

From the above description, it will be understood that the upper rotary tools 21*a* and 21*b* will be simultaneously rotated in the cylindrical holding members 43 shown in FIG. 4 to change in direction when either of the worms 67*a* and 67*b* is driven. Thus, when either of the upper rotary tools 21*a* and 21*b* is placed just beneath the ram 11 by the upper turret 13, either of the worms 67*a* and 67*b*, which are placed away from a position beneath the ram 11, is driven to rotate or index the upper rotary tools 21*a* and 21*b*.

Referring to FIG. 3, the lower rotary tools 23*a* and 23*b* are also so arranged as to be rotated on the lower turret 15 more or less in the same manner as the upper tools 21*a* and 21*b* although they are not shown in detail. In FIG. 3, there are shown worms 77*a* and 77*b* for rotating the lower rotary tools 23*a* and 23*b*, respectively, and also there is shown a connecting rod 79 connecting the worms 77*a* and 77*b*. Anyway, the lower rotary tools 23*a* and 23*b* are rotated or indexed on the lower turret 15 to change in direction in the same manner as the upper rotary tools 21*a* and 21*b* when either of the worms 77*a* or 77*b* is driven.

Referring again to FIGS. 2 and 3, in order to rotate or index the upper rotary tools 21*a* and 21*b* and the lower rotary tools 23*a* and 23*b*, a motor 81 such as a servomotor having a shaft 83 is provided near the upper and lower turrets 13 and 15 on a portion of the turret punch press 1 to drive the worms 67*a* and 67*b*. The motor 81 is connected to a gear box 85 which is mounted also near the upper and lower turrets 13 and 15. Gear box 85 includes a gear 87 fixed to the shaft 83 of the motor 81 and also includes gears 89 and 91 engaging with the gear 87. Gears 89 and 91 have shafts 93 and 95, respectively. The shafts 93 and 95 of the gears 89 and 91, respectively, are horizontally projected out of the gear box 85 toward the upper and lower turrets 13 and 15 and are connected by joints 97 and 99 to shafts 101 and 103, respectively, of pulleys 105 and 107. The shaft 101 of the pulley 105 is freely rotatably held by a bracket 109 which is mounted on the overhead frame 9, and the shaft 103 of the pulley 107 is also freely rotatably held by a bracket 111 which is mounted on the base 3. The pulley 105 is connected by a driving means 113 such as a timing belt to a transmitting means 117 which is mounted on the overhead frame 9, and the pulley 107 is likewise connected by a driving means 115 such as a timing belt to a transmitting means 119 which is mounted on the base 3. Thus, when the motor 81 is put into motion to drive the gear 87, the pulleys 105 and 107 will be simultaneously rotated by the gears 89 and 91, respectively, through the shafts 93 and 95, the joints 97 and 99 and the shafts 101 and 103, respectively, to drive the driving means 113 and 115, respectively.

Referring to FIG. 5, the transmitting means 117 and 119 are similar to each other in construction and function, and therefore the transmitting means 117 will be described in detail. The transmitting means 117 is constructed of a casing 121, and it is mounted in the proximity of the upper turret 13 on the overhead frame 9 so as to drive the worms 67*a* and 67*b* for rotating or indexing the upper rotary tools 21*a* and 21*b*.

The transmitting means 117 comprises a pulley 123 on which the driving means 113 is trained from the pulley 105 shown in FIG. 3, and the pulley 123 shown in FIG. 5 is fixed to a shaft 125 which is horizontally and rotatably journaled in bearings 127 held in the casing 121. The shaft 125 of the pulley 123 is provided at its end with a braking means 129 such as an electromagnetic brake means, and also there is provided a gear 131 which is coaxially fixed to the shaft 125. The gear 131 is in engagement with another gear 133 which is provided on a cylindrical rotary member 135 that is formed at its inner bore with a female spline 135S and is horizontally and rotatably journaled in bearings 137 held in the casing 121. Thus, the cylindrical rotary member 135 will be rotated on the bearings 137 by the pulley 123, the shaft 125, and the gears 131 and 133, when the pulley 123 is driven by the motor 81 (see FIG. 3) through the gears 87 and 89, the shafts 93 and 101, the pulley 105, and the driving means 113.

Referring further to FIG. 5, a spline shaft 139 is slidably inserted in the cylindrical rotary member 135 in engagement with the female spline 135S in such a manner to horizontally project out of the casing 121. Thus, the spline shaft 139 can be horizontally slid along the female spline 135S of the cylindrical rotary member 135, and also it can be rotated together with the cylindrical rotary member 135 when the gear 133 is driven by the gear 131 and the pulley 123. The spline shaft 139 is provided at its projecting end with a coupling member 141 which is fixed thereto by a pin 143 and is formed at its end with a concavity 141C being horizontally open. The concavity 141C of the coupling means 141 is somewhat V-shaped in section and is so designed as to be brought into engagement with the pointed end 67P of the worm 67*a* or 67*b* to drive the worms 67*a* and 67*b*. Strictly stated, the coupling means 141 is bifurcated to have the V-shaped concavity 141C; the pointed end 67P of the worms 67*a* and 67*b* is formed to be a tapered plate. The end of the spline shaft 139 opposite to the coupling means 141 is horizontally extended into a cylinder 145 having a cap 147 and is rotatably journaled in bearings 149 which are provided in a piston 151 slidably inserted in the cylinder 145. The spline shaft 139 is so arranged as to be rotated in the bearings 149 in the piston 151 of the cylinder 145 and is horizontally moved together with piston 151 in the cylinder 145 as well as in the cylindrical member 135. Also, the piston 151 of the cylinder 145 is kept biased by a spring 153 toward the cap 147 and is provided with a rod member 155 which is slidably and horizontally projected out of the cylinder 145 through the cap 147 for a purpose to be described hereinafter.

In the above described arrangement, the spline shaft 139 is usually kept biased away from the upper turret 13 by the spring 153 by means of the piston 151 of the cylinder 145 in order to keep the concavity 141C of the coupling means 141 out of engagement with the pointed end 67P of the worm 67*a* or 67*b*. However, when the piston 151 of the cylinder 145 is urged against the spring 153 by hydraulic or pneumatic fluid, the spline shaft 139 will be moved toward the upper turret 13 in the cylindrical rotary member 135 and the cylinder 145 in order to bring the concavity 141C of the coupling means 141 into engagement with the pointed end 67P of the worm 67*a* or 67*b*. Thus, it will be understood that the spline shaft 139 can drive the worm 67*a* or 67*b* to rotate or index the upper tools 21*a* and 21*b* when it is kept urged toward the upper turret 13 in order to keep the concavity 141C of the coupling means 141 in engagement with the pointed end 67P of the worm 67*a* or 67*b*. Of course, it will be understood that the spline shaft 139 which has been keeping the coupling means 141 in engagement with the worm 67*a* or 67*b* will be returned by the spring 153 to its original position when the hydraulic or pneumatic fluid is drained from the cylinder 145.

Referring again to FIG. 5, the coupling means 141 is provided with a key way 141R, and there is provided a key member 157 on a portion of the casing 121 of the transmitting means 117. Particularly, the coupling means 141 is so arranged that it can be moved away from the upper turret 13 to bring the concavity 141C out of engagement with the point end 67P of the worms 67*a* and 67*b* only when the key way 141R is in alignment with the key member 157. Also, the key way 141R and the key member 157 are so arranged that they are in alignment with each other only when the worms 67*a* and 67*b* have placed the upper rotary tools 21*a* and 21*b* at their original rotational positions. In this connection, the detecting means 75*a* and 75*b* which have been described hereinbefore in regard to FIG. 2 are so arranged as to detect the rotational positions of the upper rotary tools 21*a* and 21*b* and stop the motor 81 from driving the worms 67*a* and 67*b* so as to stop the upper rotary tools 21*a* and 21*b* at their original rotational positions. Furthermore, in order to detect the position of the coupling member 141, a dog member 159 is fixed to the rod member 155 of the piston 151 of the cylinder 145 in order to cooperate with detecting means 161 and 163 which are provided on a portion of the overhead frame 9.

From the above description, it will be understood that the coupling means 141 will bring the concavity 141C out of engagement with the pointed end 67P of the worms 67*a* and 67*b* only when the upper rotary tools 21*a* and 21*b* are at their original rotational positions. Thus, when the worms 67*a* and 67*b* are not to be rotated by the coupling means 141 and the spline shaft 139, both of the upper rotary tools 21*a* and 21*b* are always kept at their original rotational positions so that they may be readily used.

Although the descriptions have been made above only about the upper rotary tools 21*a* and 21*b*, the lower rotary tools 23*a* and 23*b* are also rotated or indexed more or less in the same manner. Also, it will be understood that the upper rotary tools 21*a* and 21*b* and the lower rotary tools 21*a* and 21*b* and the lower rotary tools 23*a* and 23*b* are simultaneously or synchronously rotated or indexed, since the transmitting means 117 and 119 are simultaneously driven by the motor 81 through the gears 87, 89 and 91.

Referring further to FIGS. 2 and 3, the upper and lower turrets 13 and 15 are provided with fixing means 165 and 167 which are so designed as to keep fixing the upper rotary tools 21*a* and 21*b* and the lower rotary tools 23*a* and 23*b*, respectively. Since the fixing means 165 and 167 are more or less the same in construction and function, description will be made only about the fixing means 165 for holding the upper rotary tools 21*a* and 21*b* fixed.

Figure 6:
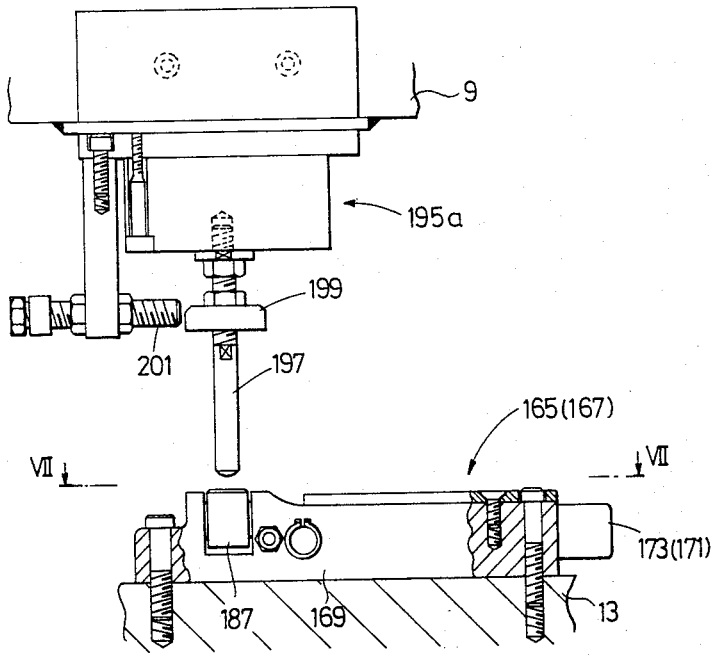
FIG. 6 is an enlarged and elevational view taken along the line VI—VI of FIG. 3 and viewed in the direction of the arrows.
Figure 7:
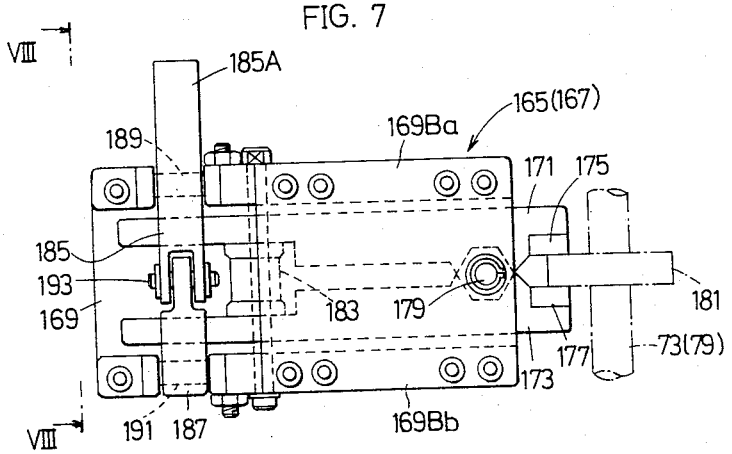
FIG. 7 is a top plan view taken along the line VII—VII of FIG. 6 and viewed in the direction of the arrows.
Figure 8:
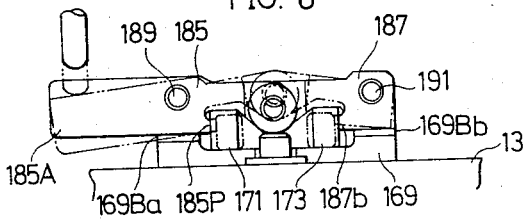
FIG. 8 is an elevational view taken along the line VIII—VIII of FIG. 7 and viewed in the direction of the arrows.

Referring to FIGS. 6, 7 and 8, the fixing means 165 comprises a base 169 which has a pair of bank-like projections 169 B*a* and 169 B*b*, and it comprises also a pair of clamping members 171 and 173 which have jaws 175 and 177, respectively, and are pivotally connected with each other by a pin 179 vertically fixed to the base 169. The fixing means 165 is mounted on the upper turret 13 in such a manner as to enable the jaws 175 and 177 to clamp a ring member 181 fixed to the connecting rod 73 which connects the worms 67*a* and 67*b* shown in FIG. 5 for rotating the upper tools 21*a* and 21*b* in FIG. 4 as has been described hereinbefore. The clamping members 171 and 173 are kept biased by a spring 183 so as to keep the jaws 175 and 177 usually clamping the ring member 181 of the connecting rod 73. In order to enable the clamping members 171 and 173 to release the ring member 181 of the connecting rod 73, there are provided a pair of bell crank members 185 and 187 which are pivotally held on the bank-like projections 169 B*a* and 169 B*b*, respectively, by horizontal pins 189 and 191, respectively, and are loosely connected with each other by a pin 193. The bell crank members 185 and 187 are provided with pressing portions 185P and 187*b*, respectively, for pressing the ends of the clamping members 171 and 173 against the spring 183. Although the bell crank members 185 and 187 are similar to each other in construction, the bell crank member 185 is provided with an arm portion 185A which is to be downwardly depressed. The arrangement is such that the pressing portions 185P and 187*b* of the bell crank members 185 and 187 will press the ends of the clamping members 171 and 173 against the spring 183 to enable the jaws 175 and 177 to release the ring member 181 of the connecting rod 73 when the arm portion 185A of the bell crank member 185 is downwardly depressed.

As shown in FIGS. 3 and 6, in order to depress the arm portion 185A of the bell crank member 185 of the fixing means 165, a pair of driving means 195*a* and 195*b*, such as hydraulic or pneumatic motors each having a pushing rod 197, are mounted on the overhead frame 9. The arrangement is such that either of the driving means 195*a* or 195*b* will depress the arm portion 185A of the bell crank member 185 by means of the pushing rod 197 according to the rotational position of the upper turret 13, since the fixing means 165 is carried by the upper turret 13 to be changed in position. Of course, each of the driving means 195*a* and 195*b* is so arranged as to downwardly urge the pushing rod 197 to depress the arm portion 185A of the bell crank member 185 to release the ring member 181 of the connecting rod 73. Also, in order to detect whether or not the pushing rod 197 is lowered, each of the driving means 195*a* and 195*b* is provided with a dog member 199 and a detecting means 201 such as a proximity switch.

In the above described arrangement, the connecting rod 73 is normally kept fixed by the fixing means 165 to keep the worms 67*a* and 67*b* and the upper rotary tools 21*a* and 21*b* stopped from rotating. However, the connecting rod 73 will be released from the fixing means 165 to enable the worms 67*a* and 67*b* to rotate or index the upper tools 21*a* and 21*b* when the pushing rod 197 is lowered by the driving means 195*a* or 195*b* to depress the arm portion 185A of the bell crank member 185 of the fixing means 165. Also, the worms 67*a* and 67*b* are driven to rotate or index the upper rotary tools 21*a* and 21*b* after the detecting means 201 has detected that the pushing rod 197 has been lowered by the driving means 195*a* or 195*b* to enable the fixing means 165 to release the connecting rod 73.

Although the description has been made above only about the fixing means 165 for fixing the upper rotary tools 21*a* and 21*b*, the fixing means 167 for fixing the lower rotary tools 23*a* and 23*b* is constructed and arranged more or less in the same manner as has been described hereinbefore. However, driving means 203*a* and 203*b*, shown in FIG. 3, corresponding to the driving means 195*a* and 195*b* for the fixing means 165 are mounted on the top surface of the base 3 and they are so arranged as to act on the fixing means 167 by means of an intermediate rod 205 which is vertically slidably provided through the lower turret 15.

Figure 9:
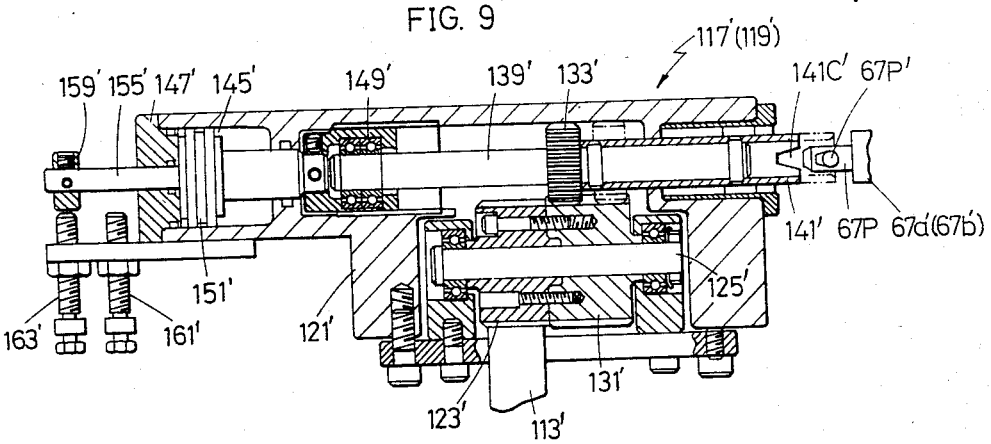
FIG. 9 is a sectional view showing a second embodiment of the portion shown in FIG. 5.

Referring to FIG. 9, there is shown as a second embodiment a transmitting means 117' which corresponds to the transmitting means 117 of the first embodiment best shown in FIG. 5. Since the transmitting means 117' of the second embodiment is similar to the transmitting means 117 of the first embodiment, elements common to the first embodiment will be designated by numerals which are common to the first embodiment but are accompanied by primes (') and will be described in detail.

In the second embodiment, a shaft 139' having no spline is employed instead of the spline shaft 139 of the first embodiment so as to be horizontally moved by a piston 151' of the cylinder 145', and a gear 133' is directly fixed to the shaft 139'. Also, a gear 131', which is larger in thickness so as to have longer teeth, is disposed in engagement with the gear 133' in a manner such that the gear 133' can be axially moved with its teeth in engagement with the gear 131'.

The shaft 139' is provided at its end with a cylindrical coupling member 141' which is bifurcated to have a V-shaped concavity 141C'. On the other hand, worms 67*a'* and 67*b'*, which are arranged to act in the same manner as the worms 67*a* and 67*b* of the first embodiment, are each provided at its end with a cross pin 67P'. More particularly, the V-shaped concavity 141C'' of the coupling member 141' and the cross pin 67P' are so designed as to be brought into engagement with each other so as to enable the shaft 139' and the gear 133' to drive the worms 67*a'* and 67*b'*.

As has been so far described above, the turret punch press 1 according to the present invention is so arranged that the upper rotary tools 21*a* and 21*b* and the lower rotary tools 23*a* and 23*b* are rotated or indexed to punch in the workpiece W a variety of holes which are identical in shape and size and are different in direction. The upper rotary tools 21*a* and 21*b* and the lower rotary tools 23*a* and 23*b* can be automatically simultaneously and synchronously rotated in the upper and lower turrets 13 and 15 by the servomotor 81 through the gears 87, 89 and 91. The coupling means 141 of the transmitting means 117 and 119 are so arranged as to bring the concavity 141C out of engagement with the pointed end 67P of the worms 67*a* and 67*b* only when the upper rotary tools 21*a* and 21*b* and the lower rotary tools 23*a* and 23*b* are at their original rotational positions. Therefore, the upper rotary tools 21*a* and 21*b* and the lower rotary tools 23*a* and 23*b* will be automatically returned to their original rotational positions for the convenience of succeeding operations as soon as they are put of operation. Also, the upper rotary tools 21*a* and 21*b* and the lower rotary tools 23*a* and 23*b* are kept fixed by the fixing means 165 and 167 on the upper and lower turrets 13 and 15 while they are not rotated or indexed so that they can perform accurate punching actions.

Lastly, it is to be noted that only one of the parts of the upper and lower rotary tools 21*a* and 23*a* and the upper and lower rotary tools 21*b* and 23*b* can be rotated for the purpose of the present invention although both of them has been described as rotatable above.

Although a preferred form of the present invention has been illustrated and described, it should be understood that the device is capable of modification by one skilled in the art without departing from the principles of the invention. Accordingly, the scope of the invention is to be limited only by the claim appended hereto.

I claim:

1. A turret punch press, comprising:

a rotatable upper turret;

a rotatable lower turret connected with the rotatable upper turret;

a plurality of upper tools held in the rotatable upper turret;

a plurality of lower tools, held in the rotatable lower turret, for coaction with the plurality of upper tools;

one drive means for rotating at least one tool in the upper turret and at least one tool in the lower turret;

means connected to the driving means for transmitting power to the plurality of upper and lower tools; and means arranged between the transmitting means and the plurality of upper and lower tools for connecting and disconnecting the transmitting means and the plurality of upper and lower tools;

said connecting and disconnecting means each have a projecting end with a concavity which is radially inwardly tapered to be somewhat V-shaped in cross-section; and rotating means connected to the one tools having a projecting end with a pointed portion which is radially outwardly tapered to be somewhat V-shaped in cross-section for engagement with the projecting end of the connecting and disconnecting means.

2. The turret punch press, according to claim 1, wherein:

said rotating means include a worm gear on a shaft.

3. The turret punch press, according to claim 1, further comprising:

means, attached to the rotatable upper and lower turrets, for releasably fixing the plurality of upper and lower tools in position on the rotatable upper and lower turrets, respectively.

4. The turret punch press, according to claim 2, wherein:

said rotating means further includes supporting members on which the worms gear is supported.

5. The turret punch press, according to claim 1, wherein said means for transmitting power comprises:

a shaft rotatably connected to a drive means, said shaft being biased away from said connection means; and piston means for urging said shaft against said biasing means towards said connecting means.

6. The turret punch press, according to claim 5, including fluid means for activating said piston, whereby said connecting and disconnecting means engage with said means for driving the plurality of upper and lower tools.

7. A turret punch press, comprising:

a rotatable upper turret;

a rotatable lower turret connected with the rotatable upper turret;

a plurality of upper tools held in the rotatable upper turret;

a plurality of lower tools, held in the rotatable lower turret, for coaction with the plurality of upper tools;

means, arranged in the rotatable upper and lower turrets, for driving the plurality of upper and lower tools;

means, connected to the driving means, for transmitting power to the plurality of upper and lower tools; and means, arranged between the transmitting means and the plurality of upper and lower tools, for connecting and disconnecting the transmitting means and the plurality of upper and lower tools;

wherein said means for transmitting power to the plurality of upper and lower tools, includes:

a drive shaft and gear assembly;

a cylindrical rotary member having an axially extending inner bore with a female spline, said rotary member rotated by said drive shaft and gear assembly;

a spline shaft slidably inserted within the inner bore;

piston means for urging said spline shaft towards said connecting means; and a spring urging said piston means away from said connection means.

8. The turret punch press, according to claim 7, including fluid means for activating said piston whereby said connecting and disconnecting means engages with said means for driving the plurality of upper and lower tools.

9. The turret punch press, according to claim 7, wherein said driving means comprises a single drive.

10. The turret punch press, according to claim 1, wherein the transmitting means comprises a gear box adapted to transfer power from a single shaft of the drive means to parallel shafts which are connected to the connecting and disconnecting means.

* * * * *

UNITED STATES PATENT AND TRADEMARK OFFICE

CERTIFICATE OF CORRECTION

PATENT NO. : 4,532,845

DATED : August 6, 1985

INVENTOR(S) : Katsumi Jinnouchi

It is certified that error appears in the above—identified patent and that said Letters Patent is hereby corrected as shown below:

Claim 4, column 12, line 10, please change "worms" to --worm--.

Signed and Sealed this

*Twenty-sixth* Day of *November 1985*

[SEAL]

*Attest:*

DONALD J. QUIGG

*Attesting Officer*

*Commissioner of Patents and Trademarks*